United States Patent [19]

Dickerson

[11] 4,323,188

[45] Apr. 6, 1982

[54] COLLAPSIBLE CONTAINER

[75] Inventor: Robert B. Dickerson, Salem, N.C.

[73] Assignee: Container Corporation of America, Chicago, Ill.

[21] Appl. No.: 197,499

[22] Filed: Oct. 16, 1980

[51] Int. Cl.[3] ..... B65D 5/36; B65D 5/72; B65D 5/18

[52] U.S. Cl. ..... 229/41 R; 229/36; 229/17 R; 229/44 R; 229/33

[58] Field of Search ..... 229/33, 35, 17 R, 17 B, 229/34 B, 44 R, 44 CB, 34 R, 36, 41 B, 41 R; 220/62, 401

[56] References Cited

U.S. PATENT DOCUMENTS

| | | | |
|---|---|---|---|
| 1,174,012 | 2/1916 | Bristol et al. | 229/40 |
| 1,599,026 | 9/1926 | Markert | 229/34 R |
| 1,894,226 | 1/1933 | Ross | 229/36 |
| 1,928,297 | 9/1933 | Mabee | 229/34 R |
| 2,262,803 | 11/1941 | Huffield | 229/33 |
| 3,010,635 | 11/1961 | Sheldon-Williams | 229/34 B |
| 3,207,380 | 9/1965 | Hennessey | 229/17 B |
| 3,568,877 | 3/1971 | Mastrud, Jr. | 220/401 |
| 3,669,341 | 6/1972 | Hughes | 229/33 |

*Primary Examiner*—William Price
*Assistant Examiner*—Gary Elkins
*Attorney, Agent, or Firm*—R. W. Carpenter; Davis Chin

[57] ABSTRACT

A collapsible container having releasable locking tabs formed on opposed edges of end cover flaps to maintain the end wall panels in the closed position when the container is set up and in use, the end wall panels being easily openable at either end for dispensing the contents from the container.

4 Claims, 5 Drawing Figures

COLLAPSIBLE CONTAINER

BACKGROUND OF THE INVENTION

1. Field of the Invention

This invention relates generally to foldable or collapsible containers and more particularly, to a collapsible container which can be stacked onto a shelf and can be opened at either end in the stacked position for dispensing the contents within the container.

2. Description of the Prior Art

A state of the art search directed to the subject matter of this application uncovered the following patents: U.S. Pat. Nos. 1,174,012; 1,894,226; 2,262,803; 3,010,635; 3,568,877 and 3,669,341.

None of the prior art uncovered in the search disclosed a collapsible container like that of the present invention which provides edge locking means to maintain the container in the closed position. This is accomplished by arcuate-shaped cut-outs on the locking closure tabs for releasably interlocking relationship with arcuate-shaped cut-outs on the side wall panels.

SUMMARY OF THE INVENTION

An object of the present invention is to provide a new and improved collapsible container which can be stacked onto a shelf and can be opened at either end in the stacked position for dispensing the contents within the container.

It is another object of the present invention to provide a collapsible container which is formed from a one-piece blank of material that is cut, scored and can be folded for easy set-up by hand into the completed container and may be easily knocked down into the flat or unfolded condition for storage and later reuse.

It is another object of the present invention to provide a collapsible container having releasable locking tabs connected to an outer portion of opposed side edges of end cover flaps to maintain the end wall panels in the closed position when the container is set up and in use, the end wall panels being easily openable for dispensing the contents from the container.

In accordance with these aims and objectives, the instant invention is concerned with the provision of a collapsible container constructed from a one-piece blank of foldable material, which is cut and scored, consisting of a bottom panel, side wall panels, top cover flaps, and end wall panels. The side wall panels are connected along fold lines to opposed front and rear side edges of the bottom panel and are folded up at right angles to the bottom panel. The side wall panels are provided with cut-outs disposed along portions of their outer edges. The top cover flaps are connected along fold lines to upper edges of the side wall panels and are folded down in parallel relationship to the bottom panel. The end wall panels are connected along fold lines to opposed end edges of the bottom panel. A pair of end wall extension flaps are hingedly attached to opposed side edges of the end wall panels and are folded inwardly at right angles to the end wall panels. The extension flaps are disposed adjacent the respective side wall panels. End cover flaps are connected along fold lines to upper edges of the end wall panels. A pair of locking closure tabs are connected to opposed side edges of the end cover flaps and are disposed between the side wall panels and the extension flaps. The closure tabs are provided with cut-outs along portions of their inner edges. The cut-outs on the closure tabs are positioned into a releasable interlocking relationship with the cut-outs on the side wall panels to maintain the container in a closed position. The extension flaps are pivotable outwardly with the end wall panels relative to the fold lines connecting the end wall panels to the bottom panel when the container is opened for dispensing.

BRIEF DESCRIPTION OF THE DRAWINGS

These and other objects and advantages of the present invention will become more fully apparent from the following detailed description when read in conjunction with the accompanying drawings wherein.

DESCRIPTION OF THE PREFERRED EMBODIMENT

Figure 1:
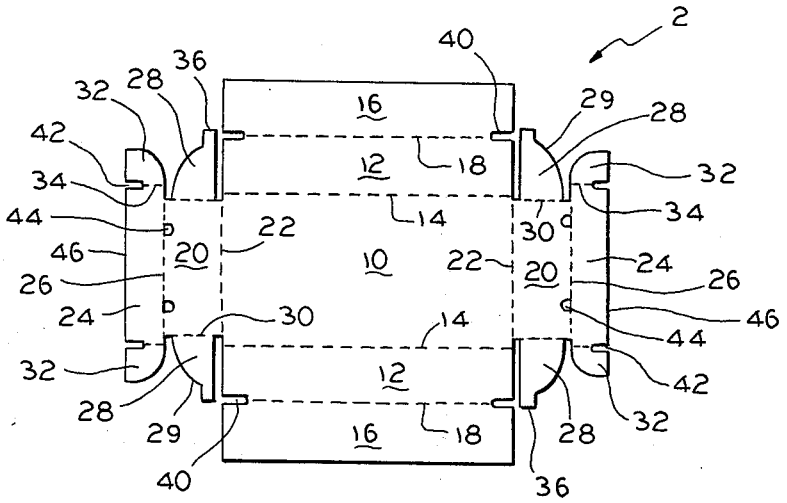
FIG. 1 is a plan view of a blank for a collapsible container constructed according to the principles of the present invention.

Referring now in detail to the various views of the drawings, there is shown in FIG. 1 a blank 2 for the collapsible container or box of the present invention comprising a rectangularly-shaped bottom panel 10 located centrally therein. Side wall panels 12 are attached along fold lines 14 to the bottom panel 10. Top cover flaps 16 are attached to the upper edges of the side wall panels 12 along fold lines 18. End walls panels 20 are also attached to the bottom panel 10 along fold lines 22. End cover flaps 24 are joined along fold lines 26 to adjacent upper edges of the end wall panels 20. Each of the end wall panels 20 are provided with a pair of end wall extension flaps 28 hingedly attached to opposed side edges thereof along fold lines 30. The flaps 28 are provided with arcuate-edged 29 for pivotal movement relative to the fold lines 22. Each of the end cover flaps 24 are provided with a pair of locking closure tabs 32 which are hingedly attached to outside edge portions thereof along fold lines 34. Each of the extension flaps 28 are formed with an integral projection or tab 36, the function and purpose of which will be described more fully hereafter.

The blank structure 2 also includes arcuate-shaped edge slots 40 formed substantially on the upper edges of the side wall panels 12 along the outer ends of the fold lines 18. Further, arcuate-shaped edge slots 42 are formed substantially on the locking closure tabs 32 on the extension of fold lines 34. In the fully assembled position, the edge slots 42 are engaged in a releasable interlocking relationship with the edge slots 40 to maintain the end wall panels 20 of the container in the closed position. Semi-circular cut-outs 44 are provided in the upper edges of the end wall panels 20 along the fold lines 26 to facilitate opening of the container.

Figure 2:
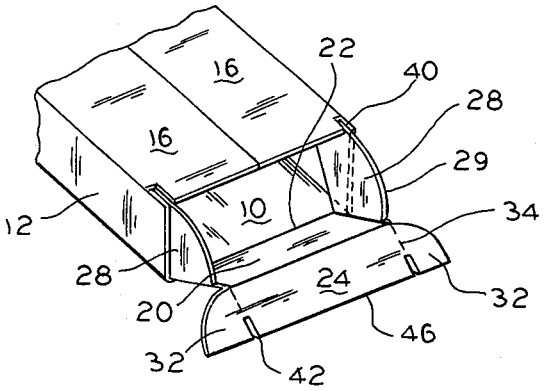
FIG. 2 is a fragmentary perspective view of one end of the container with the locking closure tabs in the unfolded position.
Figure 3:
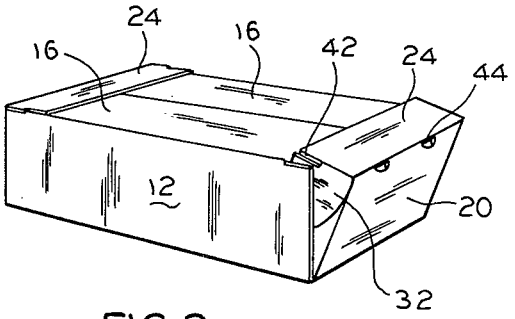
FIG. 3 is a perspective view of the container just before the arcuate-shaped cut-outs on the locking closure tabs have been interlocked with the arcuate-shaped cut-outs on the side wall panels.

In order to erect the container, the bottom panel 10 is placed on a flat surface and the respective side walls 12 are folded up perpendicularly about the fold lines 14. In this position, the top cover flaps 16 are folded inwardly at right angles to the upper edges of the side walls 12 along the fold lines 18. Next, each of the extension flaps 28 are initially folded inwardly at a right angle to the respective end wall panel 20 along the fold lines 30. As can best be seen in FIG. 2, the arcuate-edges 29 of the flaps 28 are aligned with the slots 40 so that the flaps 28 and end wall panel 20 can be moved inwardly and pivotally relative to fold lines 22 to facilitate opening and closing the end wall panels 20. At this point, the container is now ready to be packed with its contents such as shirts, sweaters or other similar garments. The next step in the set-up process is the bending of the locking closure tabs 32 upwardly at right angles to the end cover flaps 32 along the fold lines 34. As the flaps 28 are moved pivotally, the locking closure tabs 32 are placed on the outer surfaces of the tabs 28 so that the tabs 32 fit between the inside surfaces of the side wall panels and the outer surfaces of the flaps 28 to assume the position shown in FIG. 3.

Figure 4:
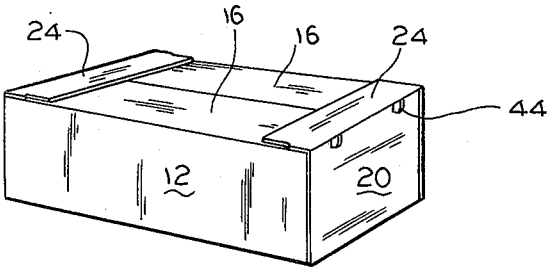
FIG. 4 is a perspective view of the container folded up in a completed set-up and locked condition.

As a final step, the end cover flaps 24 are pushed inwardly and downwardly so that the edge slots 42 at its ends engage in releasable interlocking relationship with the ends of the edge slots 40 in the completely assembled position shown in FIG. 4. In the finished stage, the bottom panel 10, side walls panels 12, top cover flaps 16, end walls panels 20 and end cover flaps 24 are all held together without the need of tape, glue and the like.

Figure 5:
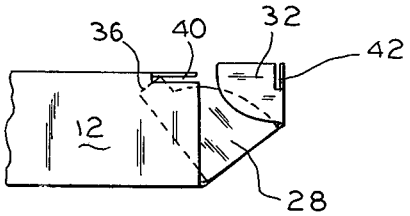
FIG. 5 is an exploded fragmentary view of one end of the container with the tab of the extension flap engaging the arcuate-shaped cut-out on the side wall panel.

When it is desired to dispense the contents from one of the ends of the container, it is only necessary to grasp an edge 46 of the end cover flap 24 and pull the flap outwardly and downwardly to the open position. Alternatively, fingers of a user could be inserted into the cut-outs 44 for pulling an end wall panel 20 downwardly thereby causing the end cover flaps 24 to move outwardly to the open position. In order to limit the outward pivotal movement of the extension flaps 28, the tabs 36 are lodged into a portion of the edge slot 40 when the container is opened for dispensing as shown in FIG. 5. After dispensing, the end wall panels 20 and the end cover flaps 24 are moved as earlier described to close the container.

From the foregoing detailed description, it can be thus seen that the present invention provides a new and improved collapsible container which permits ready dispensing at either end thereof in the stacked position. Further, due to the releasable interlocking engagement of the arcuate-shaped cut-outs, the container can be easily knocked down into the flat or unfolded condition for storage and later reuse.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A collapsible container constructed from a one-piece blank of foldable material which is cut and scored, said container comprising:

(a) a bottom panel;

(b) side wall panels connected along fold lines to opposed front and rear side edges of said bottom panel and being folded up at right angles to said bottom panel, said side wall panels having cut-outs disposed along portions of their outer edges;

(c) top cover flaps connected along fold lines to upper edges of said side wall panels and being folded down in parallel relationship to said bottom panel; and (d) end wall panels connected along fold lines to opposed end edges of said bottom panel and folded upwardly therefrom;

(e) a pair of end wall extension flaps hingedly attached to opposed side edges of said end wall panels and being folded inwardly at right angles to said end wall panels and disposed adjacent respective side wall panels;

(f) end cover flaps connected along fold lines to upper edges of said end wall panels;

(g) a pair of locking closure tabs connected to opposed side edges of said end cover flaps and being disposed between said side wall panels and said extension flaps, said closure tabs having cut-outs along portions of their inner edges;

(h) said closure tab cut-outs being positioned into a releasable interlocking relationship with said side wall panel cut-outs to maintain the container in a closed position; and (i) said extension flaps being pivotable outwardly with said end panels relative to the fold lines connecting said end wall panels to said bottom panel when the container is opened for dispensing.

2. A collapsible container as claimed in claim 1, wherein said extension flaps are formed with arcuate-shaped edges for alignment with said side wall panel cut-outs to facilitate opening and closing of said end wall panels.

3. A collapsible container as claimed in claim 1, wherein said end wall panels are formed with cut-outs along their upper edges to facilitate the opening thereof.

4. A collapsible container as claimed in claim 1, wherein said extension flaps are formed with tabs for limiting the outward movement thereof when the container is opened for dispensing.

* * * * *